US005978987A

United States Patent [19]

Wang

[11] Patent Number: 5,978,987

[45] Date of Patent: Nov. 9, 1999

[54] ARMRAIL RELEASE DEVICE FOR A COLLAPSIBLE PLAYPEN

[76] Inventor: Kun Wang, No. 51, Lane 31, Sec. 2, Changping Rd., Taichung, Taiwan

[21] Appl. No.: 09/037,501

[22] Filed: Mar. 10, 1998

[51] Int. Cl.[6] ..... A47D 7/00

[52] U.S. Cl. ..... 5/99.1; 5/93.1; 5/102; 403/329; 403/102

[58] Field of Search ..... 5/93.1, 99.1, 102, 5/98.2, 98.1; 403/329, 102, 321

[56] References Cited

U.S. PATENT DOCUMENTS

| | | | |
|---|---|---|---|
| 5,485,655 | 1/1996 | Wang | 5/99.1 X |
| 5,611,634 | 3/1997 | Wang | 5/99.1 X |
| 5,803,650 | 9/1998 | Wu | 5/99.1 X |

*Primary Examiner*—Michael F. Trettel
*Assistant Examiner*—Fredrick Conley
*Attorney, Agent, or Firm*—Bacon & Thomas

[57] ABSTRACT

A playpen includes at least one pivot bracket including a first sidewall having two ends each defining a first through hole. At least one release bracket includes a first sidewall having two ends each defining a second through hole. A pressing member movably received in the release bracket includes two pressing legs. Two retaining legs are each formed on the second sidewall of the release bracket, and each is formed with a retaining hook. At least two armrails each has one end pivotally mounted in the pivot bracket and defining a third through hole. At least two V-shaped biasing members are each mounted in a respective armrail and each has its distal end abutting the pressing leg, and a stub extending through the third through hole, the first through hole and the second through hole.

5 Claims, 6 Drawing Sheets

ARMRAIL RELEASE DEVICE FOR A COLLAPSIBLE PLAYPEN

FIELD OF THE INVENTION

The present invention relates to an armrail release device, and more particularly to an armrail release device for a playpen.

BACKGROUND OF THE INVENTION

An armrail structure is important to a collapsible playpen for protecting the infant from falling out of the playpen and for convenience in use. A conventional armrail release device for folding and expanding the armrails of a collapsible playpen is complex in structure and does not permit easy operations of folding and expanding the playpen. In addition, the conventional armrail release device is usually hidden in a fabric enclosure such that a user cannot recognize the actual position of the armrail release device easily, thereby greatly causing an inconvenience in use.

The present invention has arisen to mitigate and/or obviate the disadvantage of the conventional armrail release device for a playpen.

SUMMARY OF THE INVENTION

In accordance with one aspect of the present invention, there is provided a collapsible playpen comprising at least one pivot bracket defining an opening in a mediate portion thereof and including a first side wall having two end portions each transversely defining a first through hole and a second side wall.

At least one release bracket is mounted on the pivot bracket and includes a first side wall having a mediate portion defining a slot aligning with the opening and two end portions each transversely defining a second through hole aligning with the first through hole.

A resilient pressing member received in the slot is formed on the first side wall of the release bracket and includes two pressing legs each extending through the opening of the pivot bracket. Two retaining legs are each formed on a second side wall of the release bracket toward the first side wall and each include a distal end formed with a retaining wedge.

At least two armrails each include a first end portion and a second end portion pivotally mounted in the pivot bracket and transversely defining a third through hole alignable with the first through hole of a corresponding one of the two end portions of the pivot bracket.

At least two V-shaped biasing members are each mounted in the second end portion of a corresponding one of the two armrails and each include a first section having one distal end abutting on a corresponding one of the two pressing legs, and a stub formed on the first section and in turn extending through the third through hole, the first through hole and the second through hole, and each include a second section abutting on an inner wall of the second end portion of the armrail.

Further features of the present invention will become apparent after a careful reading of the detailed description with appropriate reference to the accompanying drawings.

DETAILED DESCRIPTION OF THE PREFERRED EMBODIMENTS

Figure 1:
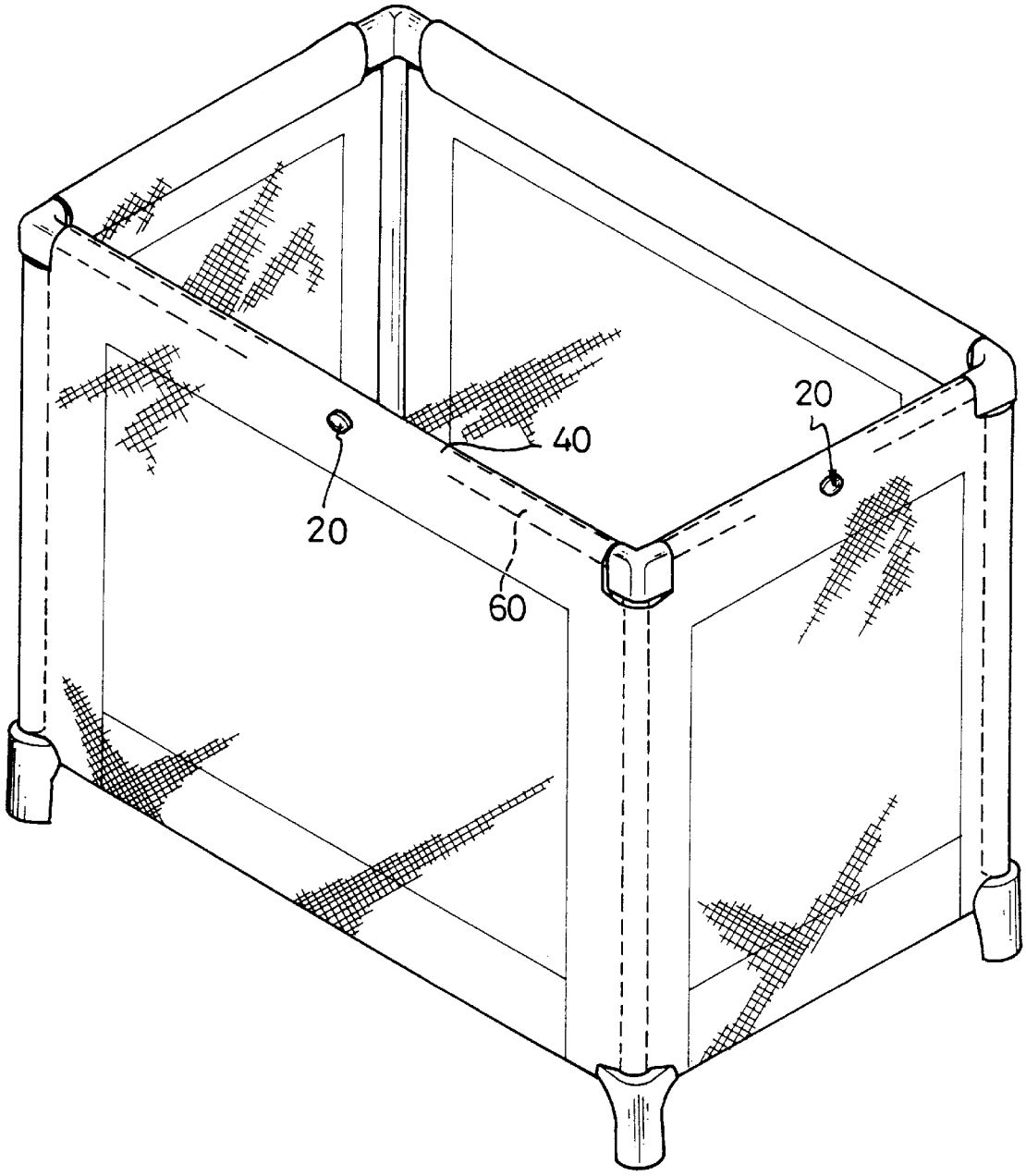
FIG. 1 is a perspective view of a collapsible playpen in accordance with the present invention.

Referring to the drawings, and initially to FIGS. 1–4, an armrail release device according to the present invention can be provided for folding and expanding armrails 60 of a collapsible playpen. The collapsible playpen comprises four pairs of armrails 60 pivotably connected with each other, and four armrail release devices each being adapted for co-operating with a respective pair of the armrails 60.

A fabric enclosure 40 encompasses each of the armrails 60 and each of the armrail release devices.

Each of the four armrail release devices comprises a pivot bracket 50 defining an opening 51 in a mediate portion thereof and including a first side wall having two end portions each transversely defining a first through hole 52 and a second side wall.

A release bracket 10 is mounted on the pivot bracket 50 and includes a first side wall having a mediate portion defining a slot 14 aligning with the opening 51 and two end portions each transversely defining a second through hole 15 aligning with the first through hole 52, and includes a second side wall.

A resilient pressing member 11 received in the slot 14 is formed on the first side wall of the release bracket 10 and includes two pressing legs 112 each extending through the opening 51 of the pivot bracket 50. Two retaining legs 12 are each formed on the second side wall of the release bracket 10 toward the first side wall and each include a distal end formed with a retaining hook 13.

Each of the two armrails 60 include a first end portion and a second end portion pivotally mounted in the pivot bracket 50 and transversely defining a third through hole 62 alignable with the first through hole 52 of a corresponding one of the two end portions of the pivot bracket 50.

Two V-shaped biasing members 30 are each mounted in the second end portion of a corresponding one of the two armrails 60 and each include a first section 31 having one distal end 312 abutting on a corresponding one of the two pressing legs 112, and a second section 32 abutting on an inner wall of the second end portion of the armrail 60.

The first section 31 of each of the biasing members 30 is formed with a stub 310 in turn extending through the third through hole 62, the first through hole 52 and the second through hole 15.

The second end portion of each of the two armrails 60 defines a bore 61 radially opposite to the third through hole 62, and the second section 32 of each of the two biasing members 30 is formed with a boss 320 received in the bore 61 of a corresponding one of the two armrails 60, thereby preventing the biasing member 30 from being detached from the armrail 60.

The second section 32 of each of the biasing members 30 includes one distal end formed with a bight 322 abutting on an abutting edge 600 of the second end portion of the armrail 60.

A position indicating knob 20 is fixedly mounted on the pressing member 11, and the fabric enclosure 40 is located between the pressing member 11 and the position indicating knob 20 such that the position indicating knob 20 can be exposed outward of the fabric enclosure 40 as shown in FIG. 1, thereby facilitating a user to recognize the correct position of the pressing member 11.

The pressing member 11 transversely defines a cavity 111 and includes an inner periphery facing the second side wall of the release bracket 10 and an outer periphery, and the position indicating knob 20 abuts on the outer periphery of the pressing member 11 and includes two abutting legs 22 each extending through the cavity 111 and each having one distal end formed with an abutting hook 23 abutting on the inner periphery of the pressing member 11, thereby coupling the position indicating knob 20 with the pressing member 11 together.

Figure 2:
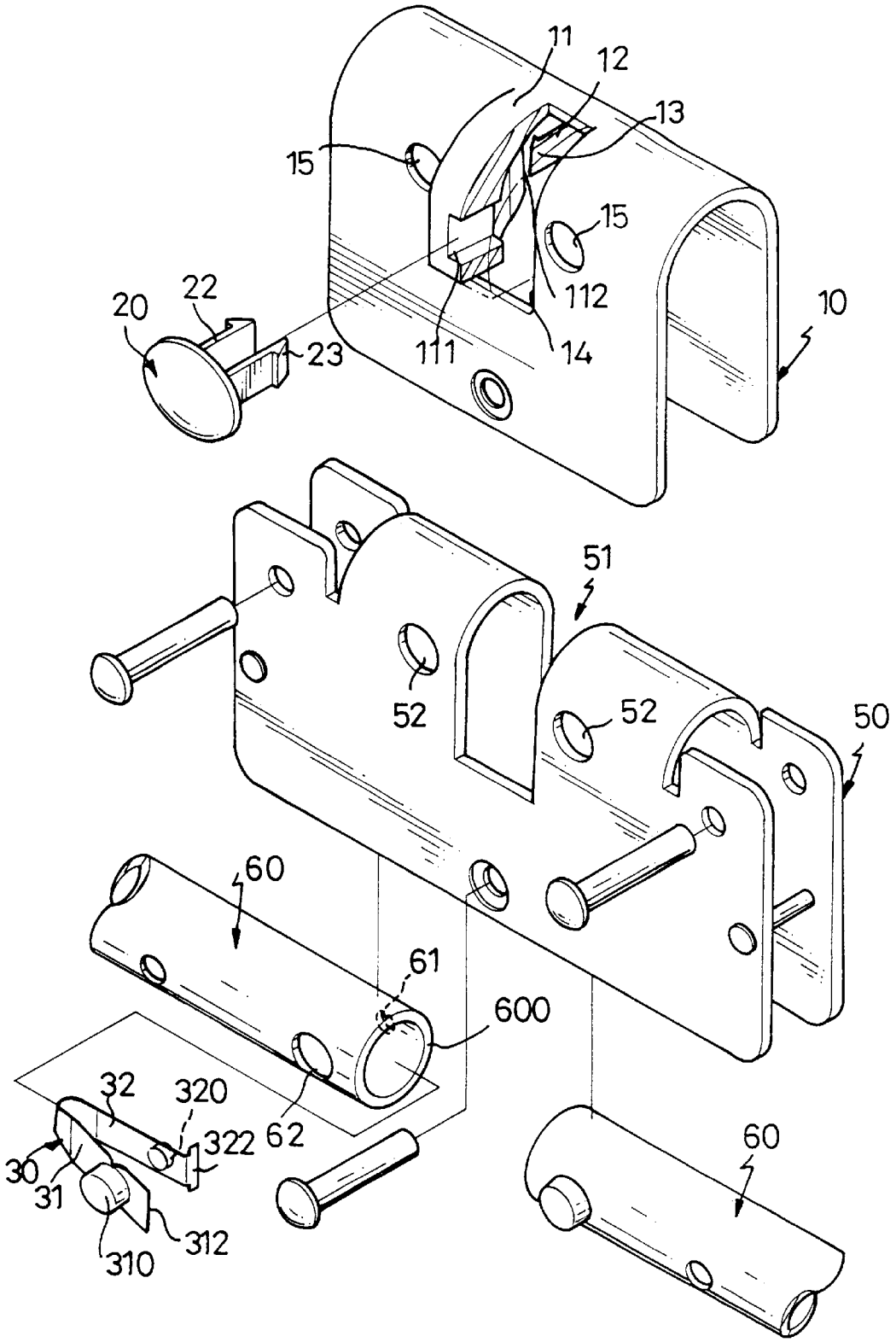
FIG. 2 is an exploded view of an armrail release device for the playpen shown in FIG. 1.
Figure 3:
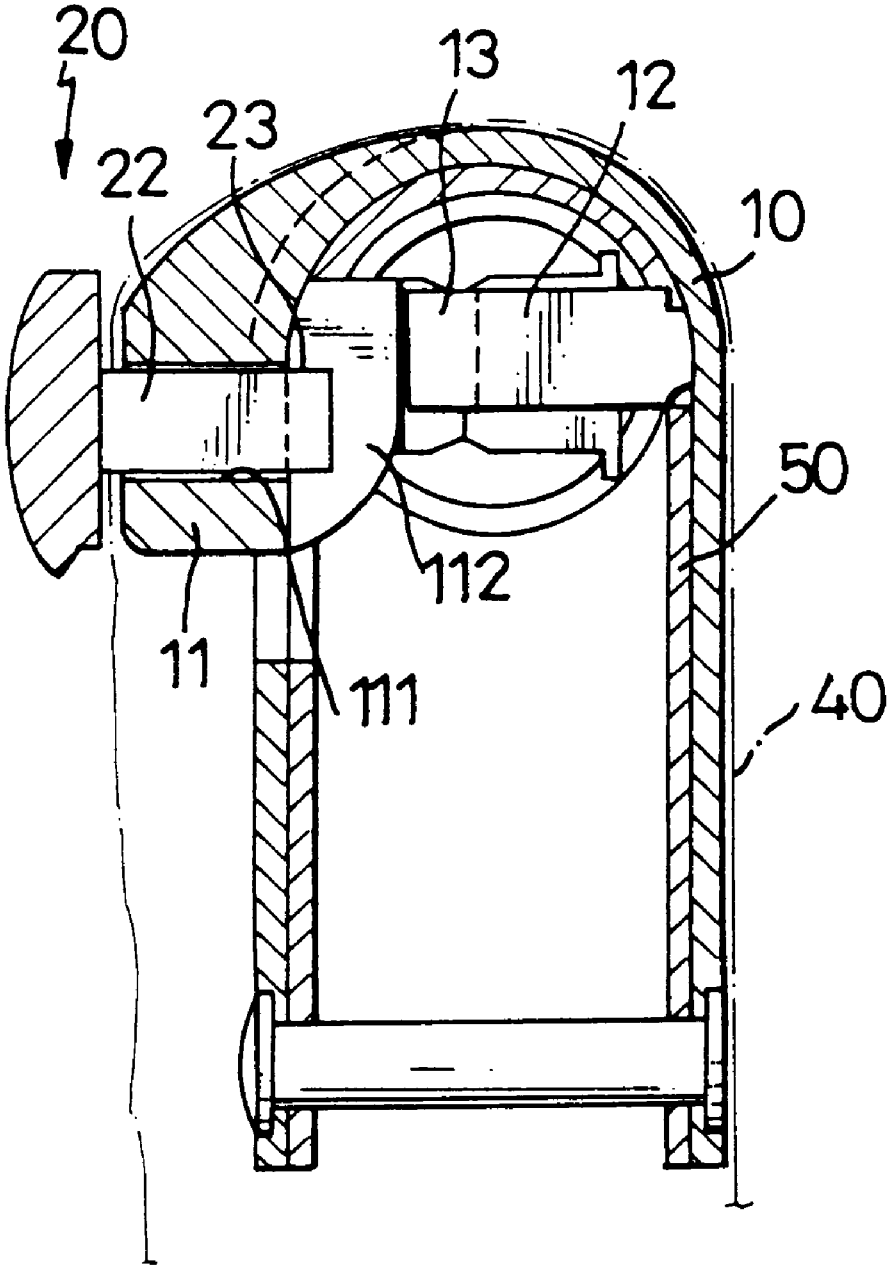
FIG. 3 is a side cross-sectional assembly view of the armrail release device shown in FIG. 2.
Figure 4:
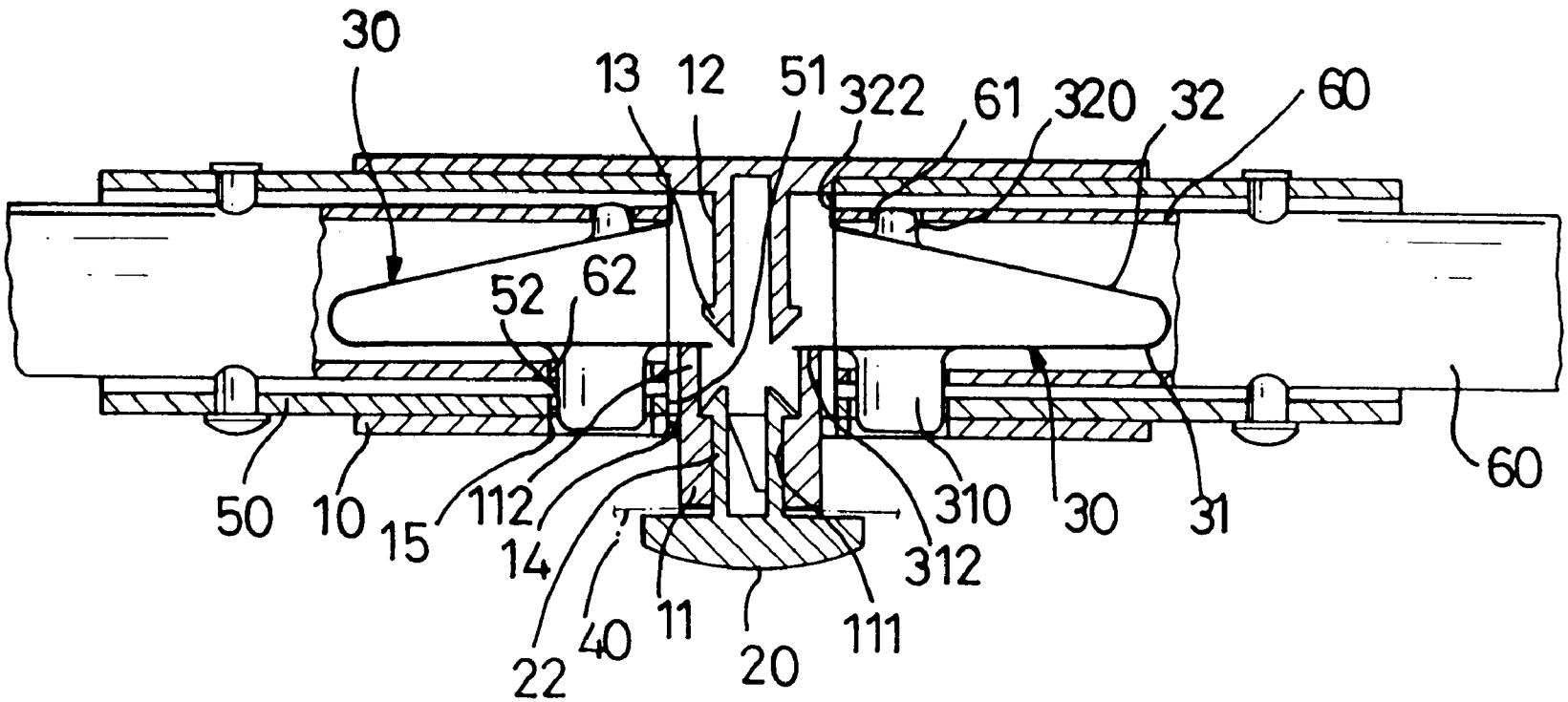
FIG. 4 is a top plan partially cross-sectional assembly view of the armrail release device shown in FIG. 2.
Figure 5:
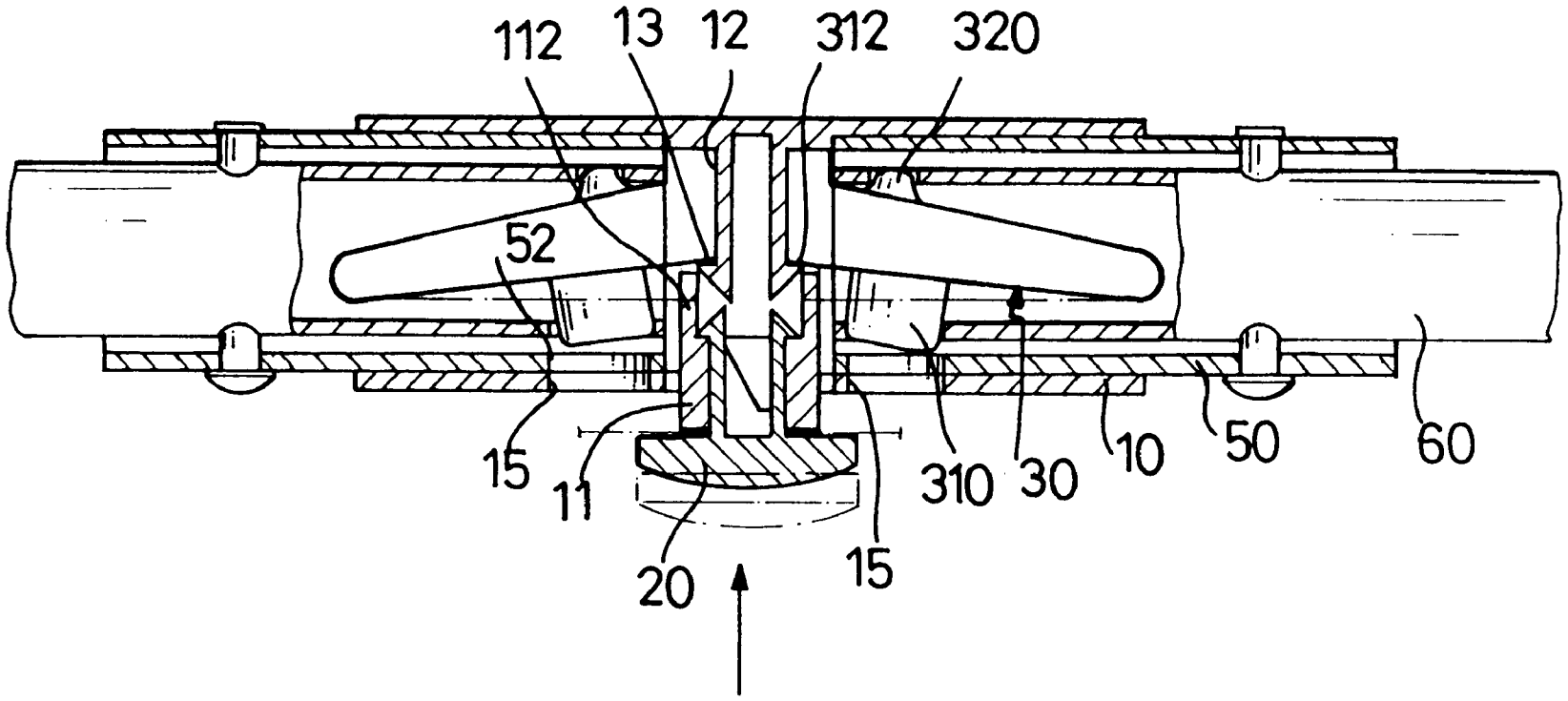
FIG. 5 is an operational view of FIG. 4.
Figure 6:
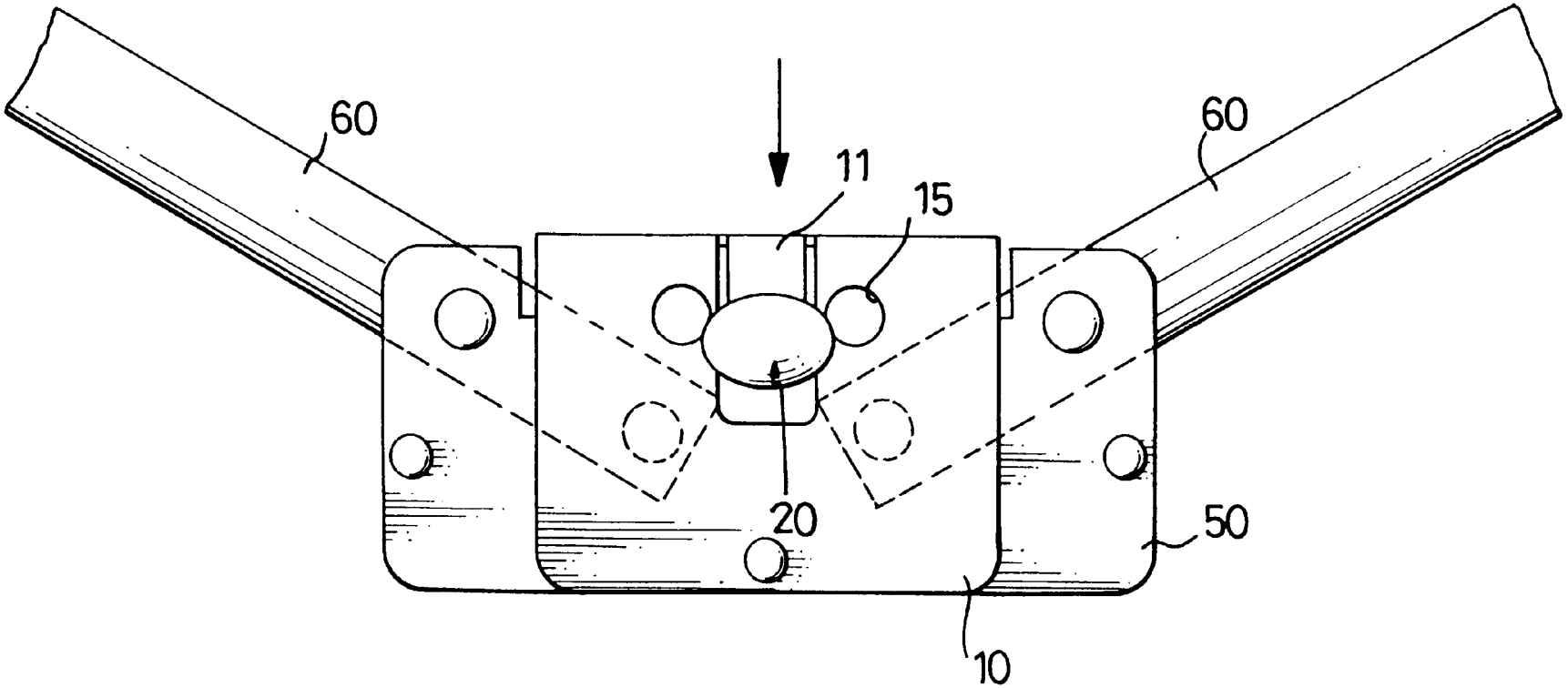
FIG. 6 is a front plan operational view of the armrail release device.

In operation, referring to FIGS. 4–6 with reference to FIGS. 1–3, the second end portion of each of the armrails 60 is initially fixed in the pivot bracket 50 by means of the stub 310 of each of the biasing members 30 in turn extending through the third through hole 62, the first through hole 52 and the second through hole 15 as shown in FIG. 4.

The position indicating knob 20 can then be pressed inwardly so as to urge the pressing member 11 toward the second side wall of the release bracket 10.

Each of the two pressing legs 112 of the pressing member 11 can be urged to move the distal end 312 of the first section 31 of a corresponding one of the two biasing members 30 from a first position as shown in FIG. 4 to a second position as shown in FIG. 5 such that the distal end 312 of the first section 31 of each of the two biasing members 30 can be retained by the retaining hook 13 of a corresponding one of the two retaining legs 12, thereby detaching the stub 310 of each of the two biasing members 30 from the second through hole 15 and the first through hole 52 such that each of the two armrails 60 can be pivoted relative to the pivot bracket 50 respectively as shown in FIG. 6, thereby in turn folding the armrails 60 of the playpen.

It is to be noted that the distal end 312 of the first section 31 of each of the two biasing members 30 can be detached from the retaining hook 13 of the respective retaining leg 12 during rotation of the armrail 60 relative to the pivot bracket 50 and the release bracket 10 such that the stub 310 can be inserted into the first through hole 52 and the second through hole 15 by means of the returning action of the biasing member 30 when the third through hole 62 again aligns with the first through hole 52 and the second through hole 15, thereby expanding the armrails 60 of the playpen.

It should be clear to those skilled in the art that further embodiments of the present invention may be made without departing from the scope and spirit of the present invention.

What is claimed is:

1. A collapsible playpen comprising:

at least one pivot bracket defining an opening in a mediate portion thereof and including a first sidewall and a second sidewall, said first sidewall having two end portions each transversely defining a first through hole;

at least one release bracket mounted on said pivot bracket and including a first sidewall and a second sidewall, said first sidewall having a mediate portion defining a slot aligning with said opening and two end portions each transversely defining a second through hole aligning with said first through hole a resilient pressing member formed on said first sidewall of said release bracket and movably received in said slot and including two pressing legs each extending through said opening of said pivot bracket, two retaining legs each formed on said second sidewall of said release bracket toward said first sidewall of said release bracket and each including a distal end formed with a retaining hook;

at least two armrails each including a first end portion and a second end portion, said second end portion pivotally mounted in said pivot bracket and transversely defining a third through hole alignable with said first through hole of one of said two corresponding end portions of said pivot bracket; and at least two V-shaped biasing members each mounted in said second end portion of one of said corresponding two armrails and each including a first section having one distal end abutting one of said two corresponding pressing legs, and a stub formed on said first section and in turn extending through said third through hole, said first through hole and said second through hole, and each including a second section abutting on an inner wall of said second end portion of said armrail.

2. The collapsible playpen in accordance with claim 1, wherein said second end portion of each said two armrails defines a bore radially opposite to said third through hole, and said second section of each of said two biasing members is formed with a boss received in said bore of one of said corresponding two armrails.

3. The collapsible playpen in accordance with claim 2, wherein said second section of each of said two biasing members has one distal end formed with a bight abutting an abutting edge of said second end portion of said armrail.

4. The collapsible playpen in accordance with claim 1, further comprising at least one position indicating knob fixedly mounted on said pressing member, and a fabric enclosure encompassing said release bracket and mounted between said pressing member and said position indicating knob.

5. The collapsible playpen in accordance with claim 4, wherein said pressing member transversely defines a cavity and includes an inner periphery and an outer periphery, said inner periphery facing said second sidewall of said release bracket, and said position indicating knob abuts said outer periphery of said pressing member and includes two abutting legs each extending through said cavity and each having one distal end formed with an abutting hook abutting said inner periphery of said pressing member.

* * * * *